US010530049B2

(12) United States Patent
Ma et al.

(10) Patent No.: US 10,530,049 B2
(45) Date of Patent: Jan. 7, 2020

(54) CABLE STRUCTURE, POWER CORD STRUCTURE, AND ELECTRICAL DEVICE

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Jianliang Ma, Foshan (CN); Zhenfeng Zhang, Foshan (CN); Songtao Li, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 16/165,753

(22) Filed: Oct. 19, 2018

(65) Prior Publication Data

US 2019/0058249 A1 Feb. 21, 2019

Related U.S. Application Data

(63) Continuation of application No. PCT/CN2017/091316, filed on Jun. 30, 2017.

(30) Foreign Application Priority Data

Aug. 30, 2016 (CN) ..... 2016 1 0770061

(51) Int. Cl.
*H01B 9/00* (2006.01)
*H01Q 1/22* (2006.01)
(Continued)

(52) U.S. Cl.
CPC ..... *H01Q 1/526* (2013.01); *H01B 9/00* (2013.01); *H01Q 1/22* (2013.01); *H01R 13/66* (2013.01)

(58) Field of Classification Search
CPC . H01Q 1/526; H01Q 1/22; H01B 9/00; H01R 13/66; H01R 13/665; H01R 31/065
(Continued)

(56) References Cited

U.S. PATENT DOCUMENTS 2,218,830 A * 10/1940 Rose ..... H01B 9/003 343/905
2,915,627 A * 12/1959 Spindler ..... H01Q 1/46 455/270
(Continued)

FOREIGN PATENT DOCUMENTS

CN 102064436 A 5/2011
CN 104241988 A 12/2014
(Continued)

OTHER PUBLICATIONS

International Search Report and Written Opinion, PCT/CN2017/091316, dated Aug. 30, 2017, 14 pgs.
(Continued)

*Primary Examiner* — Andargie M Aychillhum
*Assistant Examiner* — Michael F McAllister
(74) *Attorney, Agent, or Firm* — Morgan, Lewis & Bockius LLP

(57) ABSTRACT

The present disclosure provides a cable structure, a power cord structure and an electrical device. The cable structure includes: a power cord, a shell arranged on the power cord, and an antenna arranged in the shell. Because the antenna is arranged in the shell and does not need to be exposed to the outside, it works in a good environment and can be protected from being damaged easily and, thereby guaranteeing the working reliability and stability of the antenna. Because the shell is arranged on the power cord, the electrical device does not need to be provided with additional antenna devices, thereby improving the overall appearance, conve-
(Continued)

nience for carrying and the user experience. The shell is arranged on the power cord, the position of the shell can be at the middle, the front or different positions depending on requirements of the power cord, therefore satisfying different user needs.

7 Claims, 4 Drawing Sheets

(51) Int. Cl.
*H01R 13/66* (2006.01)
*H01R 24/28* (2011.01)
*H01Q 1/52* (2006.01)

(58) Field of Classification Search
USPC ..... 174/74 R
See application file for complete search history.

(56) References Cited

U.S. PATENT DOCUMENTS 3,649,742 A * 3/1972 Tissot ..... H01P 5/00 174/70 R
5,696,861 A * 12/1997 Schimmeyer ..... G02B 6/3817 385/75
7,177,673 B2 * 2/2007 Matsumura ..... A61B 5/0006 439/909
9,697,451 B2 * 7/2017 Bogart ..... G06K 19/0723
2007/0141869 A1 * 6/2007 McNeely ..... A61B 5/0006 439/76.1
2010/0070012 A1 * 3/2010 Chinn ..... A61N 1/0553 607/152
2014/0306647 A1 * 10/2014 Liao ..... H02J 7/0052 320/107
2014/0335730 A1 * 11/2014 Grant ..... H01R 13/6683 439/620.01
2017/0070776 A1 * 3/2017 Collins ..... H04N 21/43635

FOREIGN PATENT DOCUMENTS

CN 204425327 U 6/2015
CN 105337126 A 2/2016
CN 106299904 A 1/2017
CN 106329241 A 1/2017
CN 205985620 U 2/2017
CN 206076634 U 4/2017
CN 206196168 U 5/2017

OTHER PUBLICATIONS

First Office Action, CN201610770061-5, dated Nov. 28, 2017, 7 pgs.—No Translation Available.

* cited by examiner

CABLE STRUCTURE, POWER CORD STRUCTURE, AND ELECTRICAL DEVICE

RELATED APPLICATIONS

This application is a continuation application of PCT Patent Application No. PCT/CN2017/091316, entitled "CABLE STRUCTURE, POWER CORD STRUCTURE AND ELECTRICAL DEVICE" filed on Jun. 30, 2017, which claims priority to Chinese Patent Application No. 201610770061.5, filed with the Chinese Patent Office on Aug. 30, 2016, and entitled "CABLE STRUCTURE, POWER CORD STRUCTURE AND ELECTRICAL DEVICE", all of which are incorporated herein by reference in their entirety.

TECHNICAL FIELD

The present disclosure relates to the field of electric appliances, and in particular, to a cable structure, a power cord structure and an electrical device.

BACKGROUND

An electrical device is connected to a network or interconnected to other equipment through different communication modules. The communication modules include, but not limited to, WIFI modules, Bluetooth modules, ZIGBEE modules, and the working principle of the communication modules is to transmit information through wireless signals. The majority of communication modules in related technical solutions adopt microwave communication (microwave: electromagnetic wave of 300 MHz to 300 GHz), the transmission and reception of the wireless signals depend on antennas with specific shapes, and the lower the transmitting and receiving frequency of the communication is, the larger the appearance size of the necessary antenna is. The wireless signals are difficult to penetrate through metals and will be shielded by the metals; the wireless signals will be interfered by noise with the same frequency range, so that the communication cannot be carried out; the strength of the wireless signal decays quickly with distance; the communication modules are electronic components and require specific temperature ranges, humidity ranges and very small electromagnetic interference to work normally; and the antennas of the communication modules must be away from the metals. The structure design of the communication module on the electrical device in related art mainly includes the following several manners:

The communication module is designed in the electrical device. In this manner, the communication module will be shielded by a metal shell of the electrical device and will also be interfered by a motor, a circuit board, coils, a magnetron and the like in the household appliance.

The communication module is designed on the shell of the electrical device. In this manner, the communication ability of the communication module will be influenced by the metal shell of the electrical device and will be affected by the high temperature produced by the electrical device, and this installation manner will affect the appearance consistency of the household appliance and increase the overall size of the household appliance, thereby being not beautiful or practical.

The communication module is designed in the household appliance, and the antenna of the communication module is led out alone and is designed at the outside of the household appliance. This manner will affect the appearance consistency of the household appliance, and as the additional antenna portion is increased at the outside of the household appliance, the size of the household appliance is increased, thereby being not beautiful or practical. Moreover, the antenna mounted at the outside is liable to damage.

In summary, due to the existing structure design of the communication module, the communication module is vulnerable to being shielded, vulnerable to high temperature and vulnerable to the interference of other electronic devices, and the appearance consistency of the household appliance is also affected, thereby being not beautiful or practical.

SUMMARY

In order to solve at least one of the above technical problems, the embodiment of one aspect of the present disclosure provides a cable structure.

The embodiment of a second aspect of the present disclosure provides a power cord structure.

The embodiment of yet another aspect of the present disclosure provides an electrical device.

In view of this, according to the embodiment of one aspect of the present disclosure, the present disclosure provides a cable structure, applied to an electrical device, and characterized by including: a power cord; a shell arranged on the power cord; and an antenna arranged in the shell.

The cable structure provided by the present disclosure includes the power cord and the shell, the shell is arranged on the power cord, and the antenna is arranged in the shell. As the antenna is arranged in the shell and does not need to be exposed to the outside, so that the antenna can be protected from being damaged easily, and the antenna can work in a good environment, thereby guaranteeing the working reliability and stability of the antenna; meanwhile, the shell is arranged on the power cord, so the electrical device does not need to be provided with additional antenna devices, thereby guaranteeing the beauty of the overall appearance, guaranteeing convenience for carrying and improving the user experience. Further, the shell is arranged on the power cord, the position of the shell can be at the middle, the front or different positions satisfying requirements of the power cord, therefore different needs of the user can be satisfied, and the application range is wide.

In addition, the cable structure in the above-mentioned embodiment provided by the present disclosure can further have the following additional technical features:

In the above-mentioned technical solution, preferably, the cable structure further includes: a communication module arranged in the shell and connected to the antenna.

In the technical solution, the communication module is arranged in the shell and is arranged on the power cord together with the antenna, thereby not only being able to shorten the connection path between the communication module and the antenna and facilitate signal transmission, but also avoiding increasing additional communication modules and antenna portions at the outside of the electrical device to increase the size of the electrical device, and guaranteeing the appearance consistency, beauty and practicability of the electrical device; meanwhile, as the communication module is arranged on the power cord, the communication module can be far away from the electrical device, so the communication ability of the communication module will not be shielded by the metal shell of the electrical device, and will not be affected by a motor, a circuit board, coils, a magnetron and other factors in the electrical device, or affected by the high temperature caused by the operation of the equipment, accordingly the communication module works in a good environment, and the working reliability and stability of the communication module are guaranteed.

In the above-mentioned technical solution, preferably, the cable structure further includes: a conducting wire, wherein one end of the conducting wire is connected to the communication module or the antenna, and the other end of the conducting wire is connected to the electrical device.

In the technical solution, on the one hand, when both the communication module and the antenna are arranged in the shell, the antenna is connected to the communication module, and the antenna quickly transmits a received signal to the communication module and transmits the signal to the electrical device through the conducting wire so as to realize the intelligent control of the electrical device. On the other hand, the communication module and the antenna are not located on the same position, the communication module can be designed in the electrical device or on the shell, the antenna of the communication module is led out by the conducting wire and is designed on the power cord, and the antenna transmits the signal to the communication module of the electrical device through the conducting wire after receiving the signal so as to realize the intelligent control of the electrical device.

In the above-mentioned technical solution, preferably, the shell is detachably mounted on the power cord.

In the technical solution, as the shell is detachably mounted on the power cord, it is convenient to install and detach, thereby facilitating the maintenance and inspection and improving the efficiency of the after-sales service. Further, when the communication module or the antenna arranged in the shell is damaged, only the shell needs to be replaced, thereby avoiding the replacement of the intact power cord, reducing the cost, improving the utilization rate of the power cord and improving the satisfaction of use of the user.

In the above-mentioned technical solution, preferably, the power cord includes a first portion and a second portion separated from the first portion; the first portion is connected to the second portion by a connecting element; and the connecting element is arranged in the shell.

In the technical solution, the power cord includes the first portion and the second portion separated from the first portion, and the first portion and the second portion are connected by the connecting element that is arranged in the shell, so the shell can be located at any position of the power cord, accordingly different needs of the user are satisfied, and the application range is wide. Further, the power cord includes the first portion and the second portion, and the lengths of the first portion and the second portion can be set according to the needs of the user, thereby avoiding waste and reducing the cost, and thus the satisfaction degree of use of the user is improved.

In the above-mentioned technical solution, preferably, the connecting element includes a power cord docking interface arranged at the end portion of the shell, and a power cord interface arranged on the first portion and the second portion of the power cord and matched with the power cord docking interface.

In the technical solution, by means of the cooperation of the power cord docking interface arranged at the end portion of the shell and the power cord interface arranged on the first portion and the second portion of the power cord, the connection of the first portion of the power cord with the shell and the connection of the second portion of the power cord with the shell are realized, and then the power cords of the two portions are connected through the shell. When the portions of the power cord are damaged or the communication module and the antenna are damaged, only the power cord of the damaged portion or the communication module and the antenna need to be replaced, thereby avoiding the replacement of the power cord of the other intact portion, reducing the cost, improving the utilization rate of the power cord and improving the satisfaction degree of use of the user.

In the above-mentioned technical solution, preferably, a cover body is arranged on the shell, and the cover body is detachably mounted on the shell.

In the technical solution, as the cover body is arranged on the shell, and the cover body is detachably mounted on the shell, when any one of the communication module, the antenna and the conducting wire in the shell is damaged, troubleshooting is facilitated for maintenance and component replacement.

In the above-mentioned technical solution, preferably, the conducting wire and the power cord are of an integrated structure, and the conducting wire is integrated in the power cord.

In the technical solution, the conducting wire for connecting the communication module with the electrical device is integrated with the power cord, so that the connecting circuits of the communication module and the power supply with the electrical device are merged, the circuit layout is more neat, meanwhile a rubber coating structure of the power cord protects the conducting wire, thereby not only prolonging the service life of the conducting wire, but also guaranteeing the safety of daily use of the user.

In any one of the above-mentioned technical solutions, preferably, the shell is arranged at an end portion or a middle portion of the power cord.

In the technical solution, the shell is arranged at the end portion or the middle portion of the power cord, the shell is arranged at a proper position according to the specific use environment and function of the electrical device so as to avoid the influence of the metal shell of the electrical device, the high operation temperature, electromagnetic interference and other factors.

In any one of the above-mentioned technical solutions, preferably, the shell is an insulating shell; and both the power cord and the conducting wire are coated with insulating layers.

In the technical solution, the interference of external factors on the communication module is avoided by the insulating shell, and further, the outside of both the power cord and the conducting wire is coated with the insulating layers, so a strong wire is separated from a weak wire, and the conducting wire is not interfered by the power cord.

In any one of the above-mentioned technical solutions, preferably, the power cord at least includes a power live wire and a power zero line.

In the technical solution, on the one hand, the power cord is a 3PIN power cord and includes the power live wire, the power zero line and a power ground line; and on the other hand, the power cord is a 2PIN power cord and includes the power live wire and the power zero line. Different structures of the power cord can satisfy different needs of the user, and thus the application range is wide.

According to the embodiment of the second aspect of the present disclosure, a power cord structure is further provided, applied to an electrical device, including: a power cord plug; and the cable structure in any one of the above-mentioned technical solutions; and the power cord plug is connected to the cable structure.

The power cord structure provided by the embodiment of the second aspect of the present disclosure includes the power cord plug and the cable structure in any one of the above-mentioned technical solutions, therefore the power cord structure has all the beneficial effects of the cable structure, and the cable structure is connected to the electrical device through the power cord plug so as to guarantee the power supply and the connection between the communication module and the electrical device.

In the above-mentioned technical solution, preferably, the power cord structure further includes a power cord connector, and the power cord connector is connected to one end of the cable structure opposite to the power cord plug.

In the technical solution, one end of the cable is connected to the power cord plug, the other end of the cable is connected to the power cord connector, due to the arrangement of the power cord connector, the detachment and the deployment of the power cord structure are facilitated, meanwhile when any component in the power cord structure is damaged, a new power cord structure is just replaced, thereby generating no influence on the use of the overall machine of the electrical device, reducing the cost and improving the satisfaction degree of use of the user.

In the above-mentioned technical solution, preferably, the power cord connector includes: a power cord interface connected to the power cord; and a data line interface connected to the conducting wire.

In the technical solution, the power cord connector is provided with the power cord interface and the data line interface, which can be respectively connected to the power cord and the conducting wire, therefore the power supply is connected to the electrical device through the power cord to provide electric power for the electrical device, and the communication module or the antenna is connected to the electrical device to transmit signals so as to realize the intelligent control of the electrical device.

According to the embodiment of yet another aspect of the present disclosure, an electrical device is further provided, including: the cable structure in any one of the above-mentioned technical solutions; or the power cord structure in any one of the above-mentioned technical solutions.

The electrical device provided by the embodiment of yet another aspect of the present disclosure includes the cable structure provided by the embodiment of the first aspect of the present disclosure or the power cord structure provided by the embodiment of the second aspect, the communication module or the antenna can be hermetically arranged on the power cord, so the antenna does not need to be exposed to the outside and is unlikely to be damaged, and the communication module is also far away from the electrical device, so the communication ability of the communication module will not be shielded by the metal shell of the electrical device, and will not be affected by the motor, the circuit board, the coils, the magnetron and other factors in the electrical device, or affected by the high temperature caused by the operation of the equipment, accordingly the communication module or the antenna works in a good environment, and the working reliability and stability of the communication module or the antenna are guaranteed; no additional size is added to the electrical device, thereby guaranteeing the beauty of the overall appearance, guaranteeing convenience for carrying and improving the user experience; meanwhile, the communication module having complete functions can satisfy comprehensive needs of the user for all kinds of electrical device, thereby improving the application range of the power cord structure; and the detachable power cord structure reduces the maintenance and component replacement cost of the electrical device, prolongs the service life of the overall machine of the electrical device and improves the satisfaction degree of use of the user.

In the above-mentioned technical solution, preferably, the electrical device is a household appliance, including: a microwave oven, a microwave oven, an oven and a water heater.

In the technical solution, the cable structure or the power cord structure is applied to the microwave oven, the microwave oven, the oven and the water heater, the user can conveniently and remotely control these household appliances, including, but not limited to, opening and closing the household appliances, setting expected values, adjusting operation modes and the like, and can also transmit menus to the microwave oven, the microwave oven and the oven for automatic cooking.

Additional aspects and advantages of the present disclosure will become apparent from the following description, or may be learned by the practice of the present disclosure.

BRIEF DESCRIPTION OF THE DRAWINGS

The foregoing and/or additional aspects and advantages of the present disclosure will become apparent and understandable from the following description of the embodiments in conjunction with the accompanying drawings, wherein.

The corresponding relationship between reference signs in FIG. 1 to FIG. 4 and component names is as follows: 1 power cord structure, 10 cable structure, 102 shell, 104 antenna, 106 communication module, 108 power cord, 110 conducting wire, 112 power cord docking interface, 114 power cord interface, 12 power cord plug, 14 power cord connector, 142 power cord interface, and 144 data line interface.

DETAILED DESCRIPTION OF THE EMBODIMENTS

In order that the above-mentioned objectives, features and advantages of the present disclosure can be understood more clearly, a further detailed description of the present disclosure will be given below in combination with the accompanying drawings and embodiments. It should be noted that, in the absence of a conflict, the embodiments of the present application and the features in the embodiments can be combined with each other.

A lot of specific details are set forth in the following description so as to fully understand the present disclosure, but the present disclosure may also be implemented in other ways other than those described herein, and thus the protection scope of the present disclosure is not limited to the specific embodiments disclosed below.

A cable structure according to some embodiments of the present disclosure will be described below with reference to FIG. 1 to FIG. 4.

Figure 1:
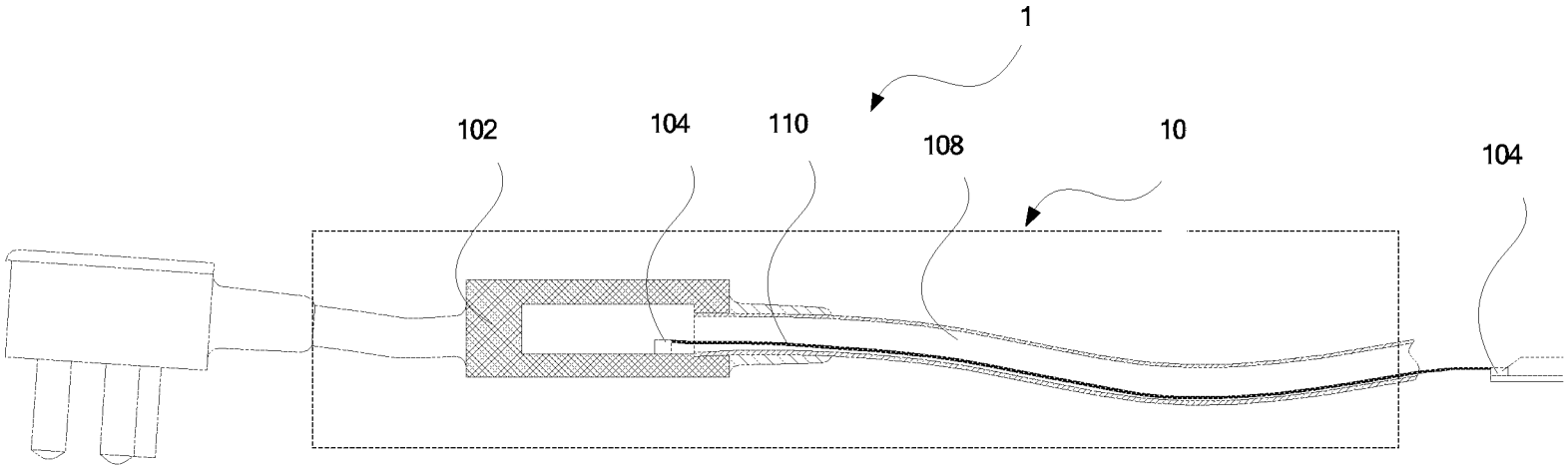
FIG. 1 is a schematic diagram of a power cord structure in an embodiment of the present disclosure.

As shown in FIG. 1, the present disclosure provides a cable structure 10, applied to an electrical device, and characterized by including: a power cord 108; a shell 102 arranged on the power cord; and an antenna 104 arranged in the shell 102.

The cable structure 10 provided by the present disclosure includes the power cord 108 and the shell 102, the shell 102 is arranged on the power cord 108, and the antenna 104 is arranged in the shell 102. As the antenna 104 is arranged in the shell 102 and does not need to be exposed to the outside, so that the antenna 104 can be protected from being damaged easily, and the antenna 104 can work in a good environment, thereby guaranteeing the working reliability and stability of the antenna 104; meanwhile, the shell 102 is arranged on the power cord, so the electrical device does not need to be provided with additional antenna 104 devices, thereby guaranteeing the beauty of the overall appearance, guaranteeing convenience for carrying and improving the user experience. Further, the shell 102 is arranged on the power cord, the position of the shell 102 can be at the middle, the front or different positions satisfying requirements of the power cord, therefore different needs of the user can be satisfied, and the application range is wide.

Figure 2:
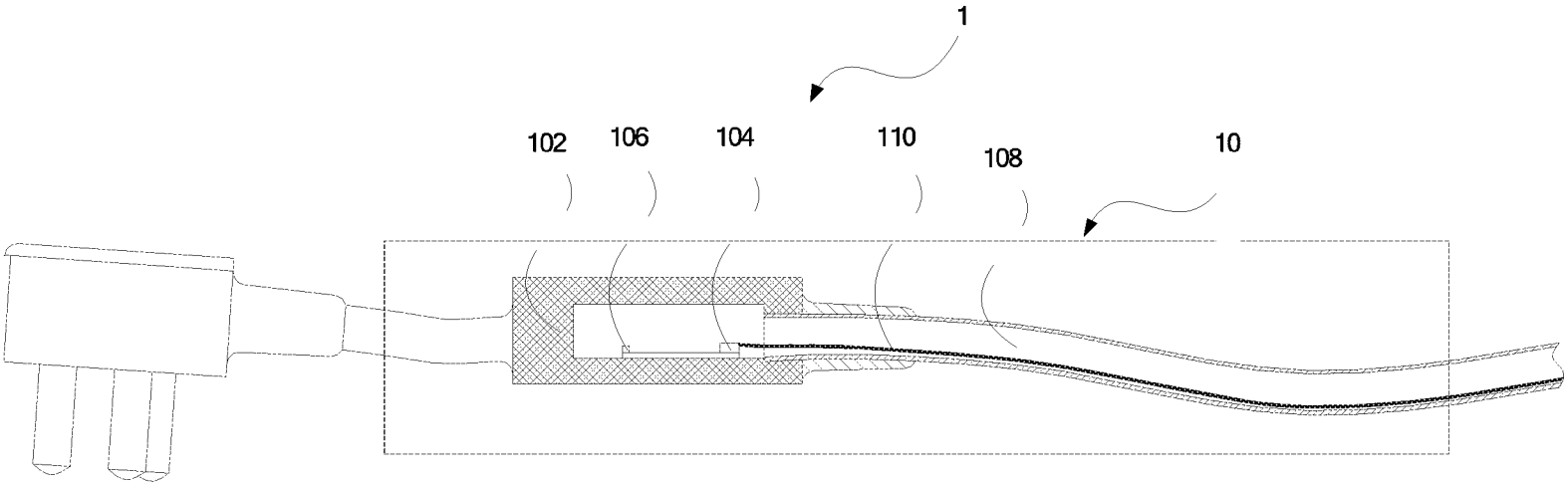
FIG. 2 is a schematic diagram of a power cord structure in an embodiment of the present disclosure.

In addition, the cable structure 10 in the above-mentioned embodiment provided by the present disclosure can further have the following additional technical features:

In an embodiment of the present disclosure, preferably, as shown in FIG. 2, the cable structure further includes: a communication module 106 arranged in the shell 102 and connected to the antenna 104.

In the embodiment, the communication module 106 is arranged in the shell 102 and is arranged on the power cord 108 together with the antenna 104, thereby not only being able to shorten the connection path between the communication module 106 and the antenna 104 and facilitate signal transmission, but also avoiding increasing additional communication modules 106 and antenna 104 portions at the outside of the electrical device to increase the size of the electrical device, and guaranteeing the appearance consistency, beauty and practicability of the electrical device; meanwhile, as the communication module 106 is arranged on the power cord, the communication module 106 can be far away from the electrical device, so the communication ability of the communication module 106 will not be shielded by the metal shell of the electrical device, and will not be affected by a motor, a circuit board, coils, a magnetron and other factors in the electrical device, or affected by the high temperature caused by the operation of the equipment, accordingly the communication module 106 works in a good environment, and the working reliability and stability of the communication module 106 are guaranteed.

Further, for example, a microwave oven includes the communication module 106, if the communication module 106 works at 2.412 GHz to 2.472 GHz, and the microwave center frequency of the microwave oven is 2.45 GHz, then the microwave oven will generate the same frequency interference on the communication module 106, the communication module 106 is arranged in the shell 102 on the power cord 108 located at the outside of the microwave oven, so the communication module 106 is far away from the microwave oven, the same frequency interference of the communication module 106 generated by the microwave oven is effectively reduced, or the microwave oven cannot interfere the communication module 106, therefore the communication ability of the communication module 106 will not be affected by the motor, the circuit board, the coils, the magnetron and other factors in the electrical device, and the satisfaction degree of use of the user is improved. Further, for example, a water heater includes the communication module 106, the shell of the water heater is generally of a full-metal sealed structure, if the communication module 106 is designed in the water heater, the communication module 106 will be shielded by the metal and cannot work, the communication module 106 is arranged in the shell 102 on the power cord 108 located at the outside of the water heater, so the communication module 106 is far away from the water heater, and the interference of the communication module 106 generated by a metal outer wall of the water heater is effectively avoided, therefore the communication ability of the communication module 106 will not be shielded by the metal shell of the electrical device, and the satisfaction degree of use of the user is improved.

Further, for example, an oven includes the communication module 106, the majority of the working temperatures of the oven are higher than 200 degrees centigrade, the oven continuously dissipates heat, so the surrounding of the shell of the oven is a high temperature area, which does not satisfy the specific temperature needs for the working of the communication module 106, thereby affecting the working effect of the communication module 106, as the communication module 106 is arranged in the shell 102 on the power cord 108 away from the oven and located at the outside of the oven, the communication module 106 works in a good environment, and the working reliability and stability of the communication module 106 are guaranteed. Further, for example, an air conditioner includes the communication module 106, and the antenna 104 connected to the communication module 106 is led to the outside of the air conditioner, thereby affecting the overall reliability and beauty of the air conditioner, accordingly the communication module 106 is arranged in the shell 102 on the power cord 108 located at the outside of the air conditioner, thereby increasing no additional size of the electrical device, guaranteeing the beauty of the overall appearance, being higher in practicability and improving the satisfaction degree of use of the user.

Figure 3:
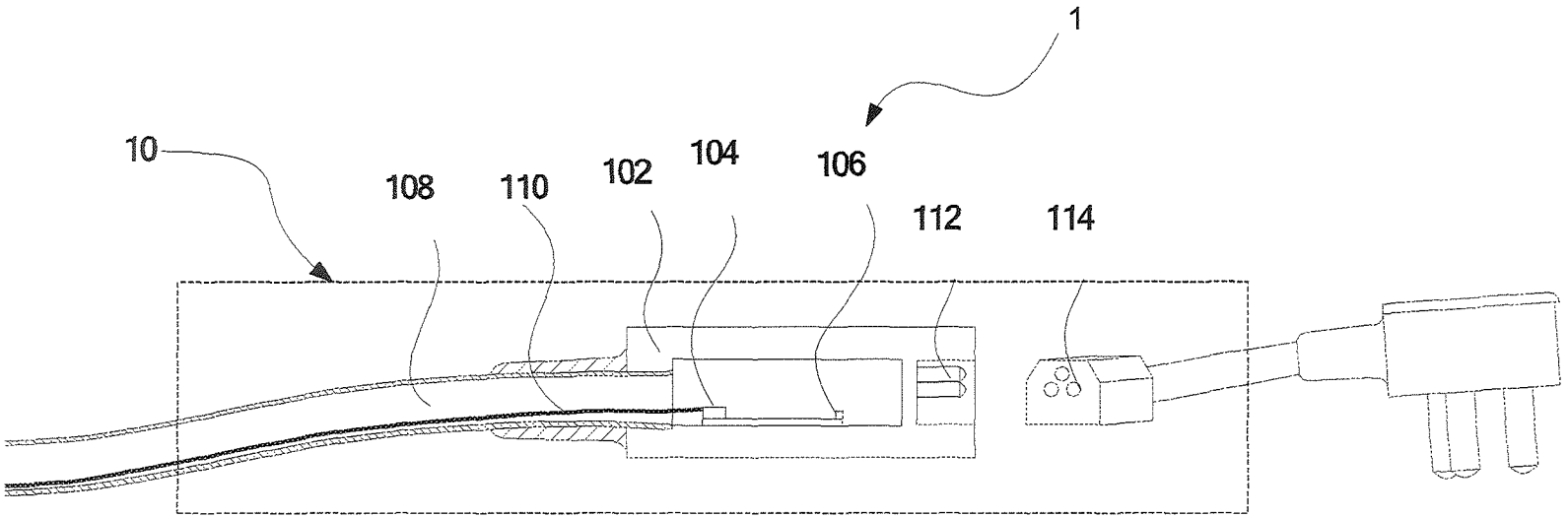
FIG. 3 is a schematic diagram of a power cord structure in an embodiment of the present disclosure.

In an embodiment of the present disclosure, preferably, as shown in FIG. 1 to FIG. 3, the cable structure further includes: a conducting wire 110, one end of the conducting wire 110 is connected to the communication module 106 or the antenna 104, and the other end of the conducting wire is connected to the electrical device.

In the embodiment, on the one hand, when the communication module 106 and the antenna 104 are arranged in the shell 102, the antenna 104 is connected to the communication module 106, and the antenna 104 quickly transmits a received signal to the communication module 106 and transmits the signal to the electrical device through the conducting wire 110 so as to realize the intelligent control of the electrical device. On the other hand, the communication module 106 and the antenna 104 are not located on the same position, the communication module 106 can be designed in the electrical device or on the shell, the antenna 104 of the communication module 106 is led out by the conducting wire 110 and is designed on the power cord 108, the antenna 104 transmits the signal to the communication module 106 of the electrical device through the conducting wire 110 after receiving the signal so as to realize the intelligent control of the electrical device.

In an embodiment of the present disclosure, preferably, as shown in FIG. 3, the shell 102 is detachably mounted on the power cord.

In the embodiment, as the shell 102 is detachably mounted on the power cord 108, it is convenient to install and detach, thereby facilitating the maintenance and inspection and improving the efficiency of the after-sales service.

Further, when the communication module 106 or the antenna 104 arranged in the shell 102 is damaged, only the shell 102 needs to be replaced, thereby avoiding the replacement of the intact power cord 108, reducing the cost, improving the utilization rate of the power cord and improving the satisfaction degree of use of the user.

In an embodiment of the present disclosure, preferably, as shown in FIG. 3, the power cord 108 includes a first portion and a second portion separated from the first portion; the first portion is connected to the second portion by a connecting element; and the connecting element is arranged in the shell 102.

In the embodiment, the power cord 108 includes the first portion and the second portion separated from the first portion, and the first portion and the second portion are connected by the connecting element that is arranged in the shell 102, so the shell 102 can be located at any position of the power cord 108, accordingly different needs of the user are satisfied, and the application range is wide. Further, the power cord 108 includes the first portion and the second portion, and the lengths of the first portion and the second portion can be set according to the needs of the user, thereby avoiding waste and reducing the cost, and thus the satisfaction degree of use of the user is improved.

In an embodiment of the present disclosure, preferably, as shown in FIG. 3, the connecting element includes a power cord docking interface 112 arranged at the end portion of the shell 102, and a power cord interface 142 arranged on the first portion and the second portion of the power cord 108 and matched with the power cord docking interface 112.

In the embodiment, by means of the cooperation of the power cord docking interface 112 arranged at the end portion of the shell 102 and the power cord interface 142 arranged on the first portion and the second portion of the power cord 108, the connection of the first portion of the power cord with the shell 102 and the connection of the second portion of the power cord with the shell 102 are realized, and then the power cords 108 of the two portions are connected through the shell 102. When the portions of the power cord 108 are damaged or the communication module 106 and the antenna 104 are damaged, only the power cord 108 of the damaged portion or the communication module 106 and the antenna 104 need to be replaced, thereby avoiding the replacement of the power cord of the other intact portion, reducing the cost, improving the utilization rate of the power cord 108 and improving the satisfaction degree of use of the user.

In an embodiment of the present disclosure, preferably, a cover body is arranged on the shell 102, and the cover body is detachably mounted on the shell 102.

In the embodiment, as the cover body is arranged on the shell 102, and the cover body is detachably mounted on the shell 102, when any one of the communication module 106, the antenna 104 and the conducting wire 110 in the shell 102 is damaged, troubleshooting is facilitated for maintenance and component replacement.

Figure 4:
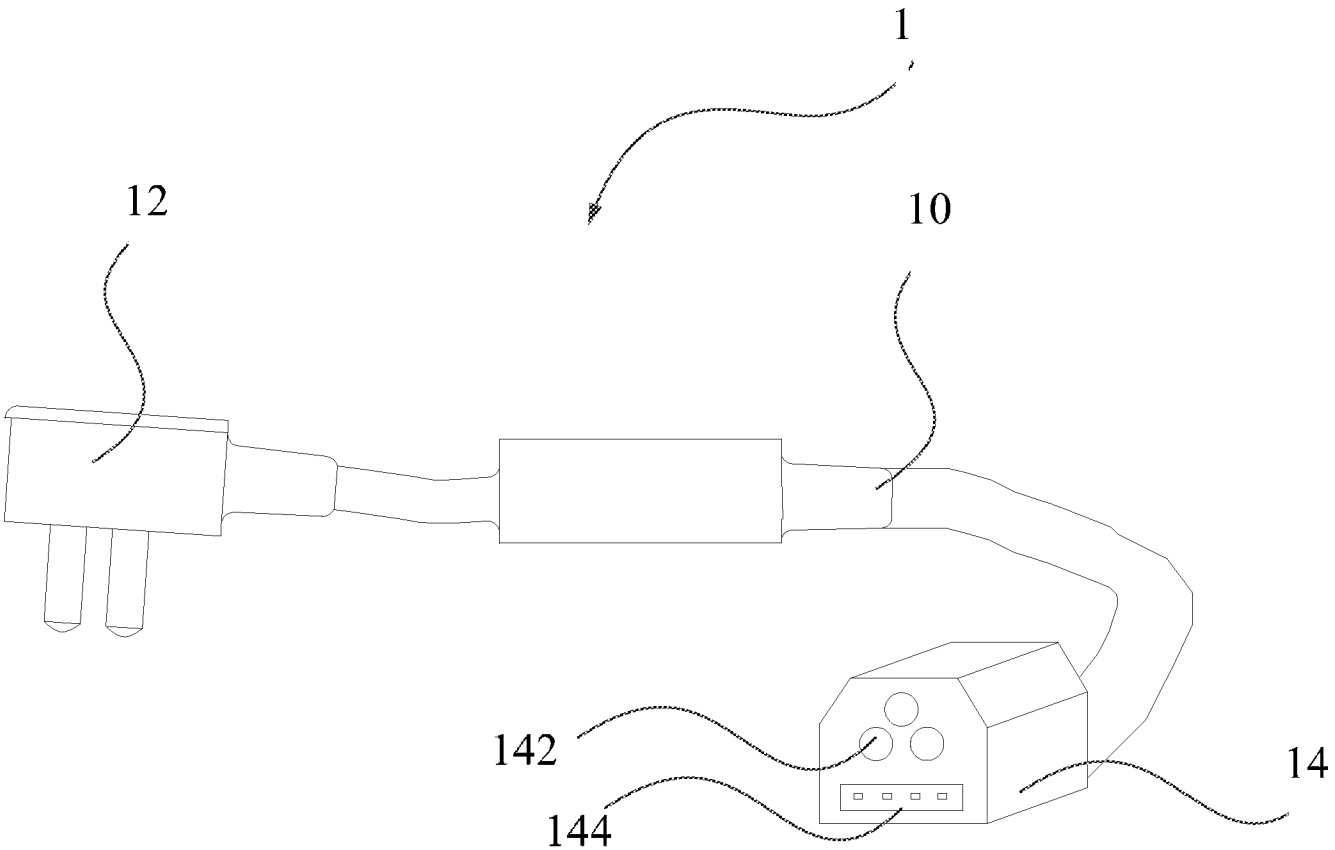
FIG. 4 is a structural schematic diagram of a power cord plug in an embodiment of the present disclosure.

In an embodiment of the present disclosure, preferably, as shown in FIG. 4, the conducting wire 110 and the power cord 108 are of an integrated structure, and the conducting wire 110 is integrated in the power cord 108.

In the embodiment, the conducting wire 110 for connecting the communication module 106 with the electrical device is integrated with the power cord, so that the connecting circuits of the communication module 106 and the power supply with the electrical device are merged, the circuit layout is more neat, meanwhile a rubber coating structure of the power cord 108 protects the conducting wire 110, thereby not only prolonging the service life of the conducting wire 110, but also guaranteeing the safety of daily use of the user.

In an embodiment of the present disclosure, preferably, the shell 102 is arranged at an end portion or a middle portion of the power cord.

In the embodiment, the shell 102 is arranged at the end portion or the middle portion of the power cord 108, the shell is arranged at a proper position according to the specific use environment and function of the electrical device so as to avoid the influence of the metal shell 102 of the electrical device, the high operation temperature, electromagnetic interference and other factors.

In an embodiment of the present disclosure, preferably, the shell 102 is an insulating shell 102; and both the power cord and the conducting wire 110 are coated with insulating layers.

In the technical solution, the interference of external factors to the communication module 106 is avoided by the insulating shell 102, and further, the outside of both the power cord 108 and the conducting wire 110 is coated with the insulating layers, so a strong wire is separated from a weak wire, and the conducting wire 110 is not interfered by the power cord.

In an embodiment of the present disclosure, preferably, the power cord 108 at least includes a power live wire and a power zero line.

In the embodiment, on the one hand, the power cord 108 is a 3PIN power cord and includes the power live wire, the power zero line and a power ground line; and on the other hand, the power cord 108 is a 2PIN power cord and includes the power live wire and the power zero line. Different numbers of the power cord interfaces 142 can satisfy different needs of the user, and thus the application range is wide. Further, there may be 4 data line interfaces 144, meanwhile four conducting wires 110 are connected, further the number of the data line interfaces 144 can be any number satisfying the needs, and different forms of the data line interfaces 144 can satisfy different needs of the user, and thus the application range is wide.

According to the embodiment of the second aspect of the present disclosure, a power cord structure 1 is further provided, applied to an electrical device, including: a power cord plug 12; and the cable structure 10 in any one of the above-mentioned technical solutions; and the power cord plug 12 is connected to the cable structure 10.

The power cord structure 1 provided by the embodiment of the second aspect of the present disclosure includes the power cord plug 12 and the cable structure 10 in any one of the above-mentioned technical solutions connected to the power cord plug, therefore the power cord structure has all the beneficial effects of the cable structure 10, and the cable structure 10 is connected to the electrical device through the power cord plug 12 so as to guarantee the power supply and the connection between the communication module 106 and the electrical device.

In an embodiment of the present disclosure, preferably, as shown in FIG. 4, the power cord structure further includes a power cord connector 14, and the power cord connector 14 is connected to one end of the cable structure 10 opposite to the power cord plug 12.

In the embodiment, one end of the cable is connected to the power cord plug 12, the other end of the cable is connected to the power cord connector 14, due to the arrangement of the power cord connector 14, the detachment and the deployment of the power cord structure 1 are facilitated, meanwhile when any component in the power cord structure 1 is damaged, a new power cord structure 1 is just replaced, thereby generating no influence on the use of the overall machine of the electrical device, reducing the cost and improving the satisfaction degree of use of the user.

In an embodiment of the present disclosure, preferably, as shown in FIG. 4, the power cord connector 14 includes: a power cord interface 142 connected to the power cord; and a data line interface 144 connected to the conducting wire 110.

In the embodiment, the power cord connector is provided with the power cord interface 142 and the data line interface 144, which can be respectively connected to the power cord 108 and the conducting wire 110, therefore the power supply is connected to the electrical device through the power cord 108 to provide electric power for the electrical device, and the communication module 106 or the antenna 104 is connected to the electrical device to transmit signals so as to realize the intelligent control of the electrical device.

According to the embodiment of yet another aspect of the present disclosure, an electrical device is further provided, including: the cable structure 10 in any one of the above-mentioned technical solutions; or the power cord structure 1 in any one of the above-mentioned technical solutions.

The electrical device provided by the embodiment of yet another aspect of the present disclosure includes the cable structure 10 provided by the embodiment of one aspect of the present disclosure or the power cord structure 1 provided by the embodiment of the second aspect, the communication module 106 or the antenna 104 can be hermetically arranged on the power cord 108, so the antenna 104 does not needs to be exposed to the outside and is unlikely to be damaged, and the communication module 106 is also far away from the electrical device, so the communication ability of the communication module will not be shielded by the metal shell of the electrical device, and will not be affected by the motor, the circuit board, the coils, the magnetron and other factors in the electrical device, or affected by the high temperature caused by the operation of the equipment, accordingly the communication module 106 or the antenna 104 works in a good environment, and the working reliability and stability of the communication module 106 or the antenna 104 are guaranteed; no additional size is added to the electrical device, thereby guaranteeing the beauty of the overall appearance, guaranteeing convenience for carrying and improving the user experience; meanwhile, the communication module 106 has complete functions and can satisfy comprehensive needs of the user for all kinds of electrical device, thereby improving the application range of the power cord structure 1; and the detachable power cord structure 1 reduces the maintenance and component replacement cost of the electrical device, prolongs the service life of the overall machine of the electrical device and improves the satisfaction degree of use of the user.

In an embodiment of the present disclosure, preferably, the electrical device is a household appliance, including: a microwave oven, a microwave oven, an oven and a water heater.

In the embodiment, the cable structure 10 or the power cord structure 1 is applied to the microwave oven, the microwave oven, the oven and the water heater, the user can conveniently and remotely control these household appliances, including, but not limited to, opening and closing the household appliances, setting expected values, adjusting operation modes and the like, and can also transmit menus to the microwave oven, the microwave oven and the oven for automatic cooking.

In the present disclosure, the term "plural" means two or more, unless otherwise expressly stated. The terms "mounted", "connected", "connection", "fixed" and the like should be generally understood. For example, the "connection" may be a fixed connection and may also be a detachable connection or an integrated connection; and the "connected" may be directly connected and can also be indirectly connected through an intermediate medium. The specific meaning of the above-mentioned terms in the present disclosure may be understood by those of ordinary skill in the art in light of specific circumstances.

In the descriptions of the present specification, the descriptions of the terms "one embodiment", "some embodiments", "specific embodiments" and the like mean that the specific features, structures, materials or features described in combination with the embodiments or examples are included in at least one embodiment or example of the present disclosure. In the present specification, the schematic expression of the above-mentioned terms does not necessarily refer to the same embodiment or example. Moreover, the specific features, structures, materials or features described may be combined in arbitrary one or more embodiments or examples in any suitable manner.

The foregoing descriptions are merely preferred embodiments of the present disclosure, and are not intended to limit the present disclosure, and various changes and modifications may be made by those skilled in the art. Any modifications, equivalent substitutions, improvements and the like made within the spirit and principle of the present disclosure shall fall within the protection scope of the present disclosure.

What is claimed is:

1. A power cord structure, comprising:
- a power cord plug;
- a power cord connector having a power cord interface and a data line interface; and
- a cable structure having a first end and a second end, wherein the first end is connected to the power cord plug and the second end is connected to the power cord connector, the cable structure further comprising:
  - a power cord connecting the power cord plug to the power cord interface;
  - a shell arranged on the power cord;
  - an antenna arranged in the shell; and
  - a conductive wire connecting the antenna to the data line interface.

2. The power cord structure of claim 1, wherein the cable structure further comprises:
- a communication module arranged in the shell and connected to the antenna.

3. The power cord structure of claim 1, wherein the shell is detachably mounted on the power cord.

4. The power cord structure of claim 3, wherein the power cord comprises a first portion and a second portion separated from the first portion; the first portion is connected to the second portion by a connecting element; and the connecting element is arranged in the shell.

5. The power cord structure of claim 1, wherein the power cord plug is connected to an electric power source and the power cord connector is connected to a household appliance.

6. The power cord structure of claim 5, wherein electric power is transmitted from the electric power source to the household appliance via the power cord interface of the power cord connector for operating the household appliance.

7. The power cord structure of claim 6, wherein digital data is transmitted from the antenna to the household appliance via the data line interface of the power cord connector for controlling the operation of the household appliance.

* * * * *